US007941876B2

(12) United States Patent
Ferber

(10) Patent No.: US 7,941,876 B2
(45) Date of Patent: May 17, 2011

(54) APPARATUS, METHOD AND SYSTEM FOR PROTECTING HIPS FROM FRACTURE, AND FOR PROVIDING IMMEDIATE RESPONSE TO HIP FRACTURE EVENTS

(76) Inventor: Robert C Ferber, Jackson Heights, NY (US)

( * ) Notice: Subject to any disclaimer, the term of this patent is extended or adjusted under 35 U.S.C. 154(b) by 0 days.

(21) Appl. No.: 11/378,113

(22) Filed: Mar. 18, 2006

(65) Prior Publication Data

US 2007/0214552 A1 Sep. 20, 2007

(51) Int. Cl.
*A41D 13/00* (2006.01)

(52) U.S. Cl. ..... 2/465

(58) Field of Classification Search ..... 2/79, 227, 2/228, 238, 69, 465, 467, 267, 16, 22, 455, 2/911, 242
See application file for complete search history.

(56) References Cited

U.S. PATENT DOCUMENTS 1,406,794 A * 2/1922 Whitley ..... 2/23
1,774,739 A * 9/1930 Mechial ..... 2/465
2,889,830 A * 6/1959 Raymond ..... 450/98
3,526,221 A * 9/1970 Garber ..... 128/95.1
3,763,866 A * 10/1973 Bienenfeld ..... 450/134
4,807,301 A * 2/1989 Ferber ..... 2/465
4,987,613 A * 1/1991 Loverdi et al. ..... 2/23
5,076,288 A 12/1991 Millard et al.
5,383,920 A 1/1995 Sikes
5,437,618 A 8/1995 Sikes
5,500,952 A * 3/1996 Keyes ..... 2/465
5,545,128 A 8/1996 Hayes et al.
5,689,836 A * 11/1997 Fee et al. ..... 2/465
5,690,609 A * 11/1997 Heinze, III ..... 602/19
5,790,981 A * 8/1998 Bzoch ..... 2/22
6,637,036 B2 * 10/2003 Beland ..... 2/227
7,042,338 B1 * 5/2006 Weber ..... 340/309.5

FOREIGN PATENT DOCUMENTS

JP 6-110 * 6/1994

OTHER PUBLICATIONS

HipGuard product website http://www.hipguard.com visited Jan. 25, 2005.
Morning StarLight Hip Protection Pads website http://www.morningstarlight.com visited Oct. 3, 2005.

* cited by examiner

*Primary Examiner* — Tejash Patel

(57) ABSTRACT

A method and device for protecting a hip bone or limiting a severity of a hip bone injury, which includes at least one pad arranged to protect the hip bone, and a wearable garment to hold the at least one pad with respect to the hip bone, the garment configured to be worn over clothing, the pad configured to wrap around an area of the hip bone in a circumferential manner, the garment including two fastening panels, each configured to face and overlap with the other fastening panel, and fastenable together in a rotatable manner around an axis perpendicular to a fastening plane, a length of the two fastening panels configured to provide a one size fits essentially all wearers.

18 Claims, 4 Drawing Sheets

APPARATUS, METHOD AND SYSTEM FOR PROTECTING HIPS FROM FRACTURE, AND FOR PROVIDING IMMEDIATE RESPONSE TO HIP FRACTURE EVENTS

FIELD OF THE INVENTION

The present invention relates to an apparatus, method and system for protecting hips from fracture, and for providing immediate response to hip fracture events.

BACKGROUND INFORMATION

Hip fractures may cause morbidity and mortality in persons, including, for example, elderly persons. With the progressive increase in the number of elderly persons in the United States, a concurrent surge in hip fractures is occurring. Hip fracture in elderly persons may result from a fall on the hip area. For example, Cummings et al. in "A Hypothesis: The Causes of Hip Fractures", Journal of Gerontology: Medical Sciences, Vol. 44, No. 4 (1989), state that about 80 to 90% of hip fractures in elderly persons are due to falls, and that fewer than 10% occur before the fall. Consequently, hip protecting devices have been advocated to reduce the risk of sustaining a hip fracture.

Hip protective devices should provide both an effective and cost-saving strategy for reducing the risk of hip fractures. To be effective, however, a hip protecting device must be worn. A major issue is patient non-compliance and/or non-adherence with wearing of such hip protecting devices. It is has been found that the non-compliance in community and institutional settings ranges from 37% to 72%.

There may be several reasons why persons do not always wear a hip protecting device when instructed to do so. Reasons for non-compliance may include, for example, discomfort (e.g., too tight and/or a poor fit), and the extra effort and time required to put on and adjust the hip protecting device. It is believed that patient compliance would be substantially increased if hip protecting devices were more comfortable and provided a better fit. Patient compliance may be increased if hip protecting devices are presented in a form that those in need of such devices would be less inclined to resist the wearing of the device, due to, for example, vanity concerns or not wanting to admit the time has come to wear such a device.

There are hip protecting devices, for example, in which the device is worn underneath clothing because the wearer may not consider the protecting device aesthetically pleasing. However, in the past 10 years or so, it is understood that a very large proportion of the wearers need to be able to take the device off, sometimes urgently, such as in a need to visit the toilet, and this cannot be done with the type of the hip protector that is worn in or as underwear. This even applies if the caregiver has to take off the garment.

Wearers of hip protectors may have different capabilities with respect to possible movements of their limbs and agility. Certain existing hip protectors may not accommodate such individual needs and/or capabilities of the wearer, particularly if the wearer cannot move certain body parts in a particular direction, in agile fashion. For example, the wearer may have arthritis or muscular weakness in the hands. It has also been understood that certain existing hip protecting devices are not easily removed or put on by the wearer or the care giver.

The material of certain existing hip protecting devices using pads can stretch and therefore allow for undesired movement of the pads with respect to a particular desired area to be protected (e.g., pads that are included in a sweatpants arrangement). For example, if a person falls off a couch, the friction from contact with the couch may cause the padding of the hip protecting device to slide away from the point to be protected.

U.S. Pat. No. 5,545,128 purports to relate to a garment worn underneath clothing for bone fracture prevention during impact from a fall, in which the undergarment has an horseshoe-shaped pad arrangement for shunting a substantial portion of impact energy from the vulnerable region to the soft tissue region. However, such a design rests on the faulty notion that only falls with an impact at right angles to the greater trochanter cause hip fractures, which is not accurate. There are many other angles at which persons may fall. At some angles, contact will not be made near the greater trochanter. For example, one may fall flat backwards or half sideways on the buttocks. Accordingly, unless the fall occurs directly on the entire horseshoe-shaped pad, the thixotropy (hardening due to impact on the protective fluid/solid) will not occur fast enough, and the device is likely to do more harm than good. Moreover, the pads, which are about one inch thick, increase the perceived width of the wearer and thus may be esthetically unacceptable to the wearer. Moreover, the horseshoe-shaped design and the direct adherence to the skin is considered an impractical solution. Hence, the device discussed in U.S. Pat. No. 5,545,128 is understood to be functionally deficient, uncomfortable, or impractical for certain wearers, such as, for example, older persons.

Furthermore, another pad arrangement, in which the pads are fixed in a tight undergarment with straps around the legs and waist so that the pads can be held precisely over the greater trochanter, is not likely to be usable by an older person with arthritic fingers.

Certain hip protecting devices, which are designed to be worn underneath clothing, may include plastic shields or foam pads that may be held in place at the hips with specially designed underwear. However, such pads may provide only limited protection. For example, such pads do not protect from a rearward fall. In the human pelvis there are two large hip bones, each consisting of three fused bones, the illium, ischium, and pubis. The hip bones form a ring around a central cavity. The fused terminal segments of the spine, known as the sacrum and coccyx, connect the hip bones at the back of the central cavity; a fibrous band connects them at the front. A backward fall may cause injury or fracture of sacrum and/or coccyx. Moreover, with the internal force transmission occurring from bone to bone, falling backwards can not only hurt the sacrum and coccyx but hard impact on them can be passed onto other bones.

SUMMARY OF THE INVENTION

The present invention provides a device for protecting a hip bone or limiting a severity of a hip bone injury. In this regard, the device may include, for example, at least one pad arranged to protect the hip bone, and a wearable garment to hold the at least one pad with respect to the hip bone, in which the garment is configured to be worn over clothing and the pad configured to wrap around an area of the hip bone in a circumferential manner.

According to an exemplary embodiment and/or exemplary method of the present invention, the hip protecting device is configured to be more easily removed as compared to other existing hip protecting devices. This may be particularly important when the wearer encounters an urgent need to remove the device, such as a toilet visit. It is essential for many older people who require incontinence pads, because the device may be used in conjunction with them. In particular, the wrap-around aspect of the hip protecting device of the present invention provides a unique solution to the problem of wearing both a hip protecting device and incontinence pads.

According to an exemplary embodiment and/or exemplary method of the present invention, the hip protecting device is put on by laying the device flat on a bedside, and the wearer sits or slides on to the device, which may then be wrapped around and fastened. If the wearer has the capability, the device may also be donned in a standing position.

According to an exemplary embodiment and/or exemplary method of the present invention, a hip protecting device includes a wrap-around pad on each side so that protection may be provided for a rearward or partially rearward fall, in addition to a sideways fall. In this regard, a hip protecting device according to the present invention may provide protection against injury or fracture to certain hip bones, or other bones in the vicinity of the hip, including, for example, the sacrum and coccyx bones.

According to an exemplary embodiment and/or exemplary method of the present invention, a hip protecting device is easily adapted to the specific protections of a variety of wearers. In particular, the hip protecting device provides a fastening device that can accommodate multiple sized and shaped wearers. Accordingly, the hip protecting device may be provided in a one-size-fits all, or essentially a one-size-fits all, configuration.

According to an exemplary embodiment and/or exemplary method of the present invention, a hip protecting device may be worn over clothing, including, for example, all types of clothing, to provide improved comfort and/or convenience. The hip protecting device of the present invention may also be provided in a one-size fits all mode, which allows the user to personally adjust the device to improve the fit that may be obtained therewith. The hip protecting device may also include a pocket to hold a variety of fall/injury avoidance electronic devices, and help summoning devices, such as, for example, a postural sensor, personal emergency response system, etc.

According to an exemplary embodiment and/or exemplary method of the present invention, the hip protecting device includes at least one pad of about 7/16' in thickness, which includes a closed cell material, such as, for example, polyvinyl chloride (PVC)-nitrile. The hip protecting device may also include two extended panels, which are configured to be self-fastening to each other so as to provide an one size fits essentially all wearers of the device. In this regard, the two panels may be fastened in various positions so as to accommodate a range of circumference of about 32 to 49 inches. Here, it is noted that to manufacture extremely large sizes, adjustments may also be made in the back of the garment in the area between the pads. The hip protecting device may further include an impact detector configured to signal for help upon detecting a fall or sudden impact.

According to an exemplary embodiment and/or exemplary method of the present invention, the hip-protecting device may be fastened by rotating two panels of the hip-protecting device around of an axis perpendicular to a fastening plane, overlapping the two panels, and pressing the two panels together. Here, the rotation is important because is makes the fastener adaptable to slight variations in an individual's anatomy. Moreover, the facing panels may be brought together at various angles with respect to the fastening plane According to an exemplary embodiment and/or exemplary method of the present invention, the hip protecting device includes an impact detector to detect a fall. In this regard, the impact detector may include, for example, an accelerometer to detect a deceleration change, and a first processing arrangement to determine if the deceleration change is within a range in which a fracture may occur.

BRIEF DESCRIPTION OF THE DRAWINGS

FIG. 1A shows a front view of an exemplary device for protecting the hip area in a human.

DETAILED DESCRIPTION

FIG. 1 AA shows an exemplary method to protect a hip bone from fracture or to limit a severity of a hip bone injury. In step S101, at least one pad is provided to protect the hip bone. For example, two pads may be provided, each pad approximately rectangular in shape with rounded edges and constructed to absorb a shock.

In step S102, the at least one pad is configured to wrap around an area of the hip bone. In particular, the at least one pad is configured to wrap around the area of the hip bone in a circumferential manner so as to conform to the particular wearer's shape.

In step S103, a one size fits all device is provided, which includes at least one pad to protect the hip bone, and which is configured to be worn over clothing. Here, the one size fits all aspect of the device may accommodate, for example, 95% of adult wearers, which may be important, for example, in terms of the application of the device in health institutions, such as nursing homes, because without such a one size fits all feature the device may be unnecessarily expensive with respect to storage and providing different sizes of the device to persons having differing sizes. Additionally, the configuration of the device so as to be worn over clothing provides certain benefits with respect to convenience and ease of use of the device. For instance, if a wearer decides to sit in once place for a particular time period, the device may be easily unfastened during this time and fastened again before rising.

In step S102, a pocket is provided on the device to hold an arrangement to notify a non-wearer of a fall occurrence. Here, the non-wearer may be, for example, a caregiver, who may assist the wearer of the device should he or she need assistance after a fall. The pocket may be configured to accommodate a wide variety of devices so that a customized solution may be provided to each wearer, if required.

In step S103, the arrangement to notify a non-wearer is provided so that both the device and the notification arrangement can be provided in one commercially available package so as to reap further economies of scale with respect to mass production of the device. Indeed, having a device that both protects hips from fracture and notifies a caregiver when the wearer falls or experiences a sudden impact to the hip area should be desirable in the context of elderly and/or injury-prone individuals who would otherwise not have access to such features with other existing hip protecting devices.

Figure 1A:
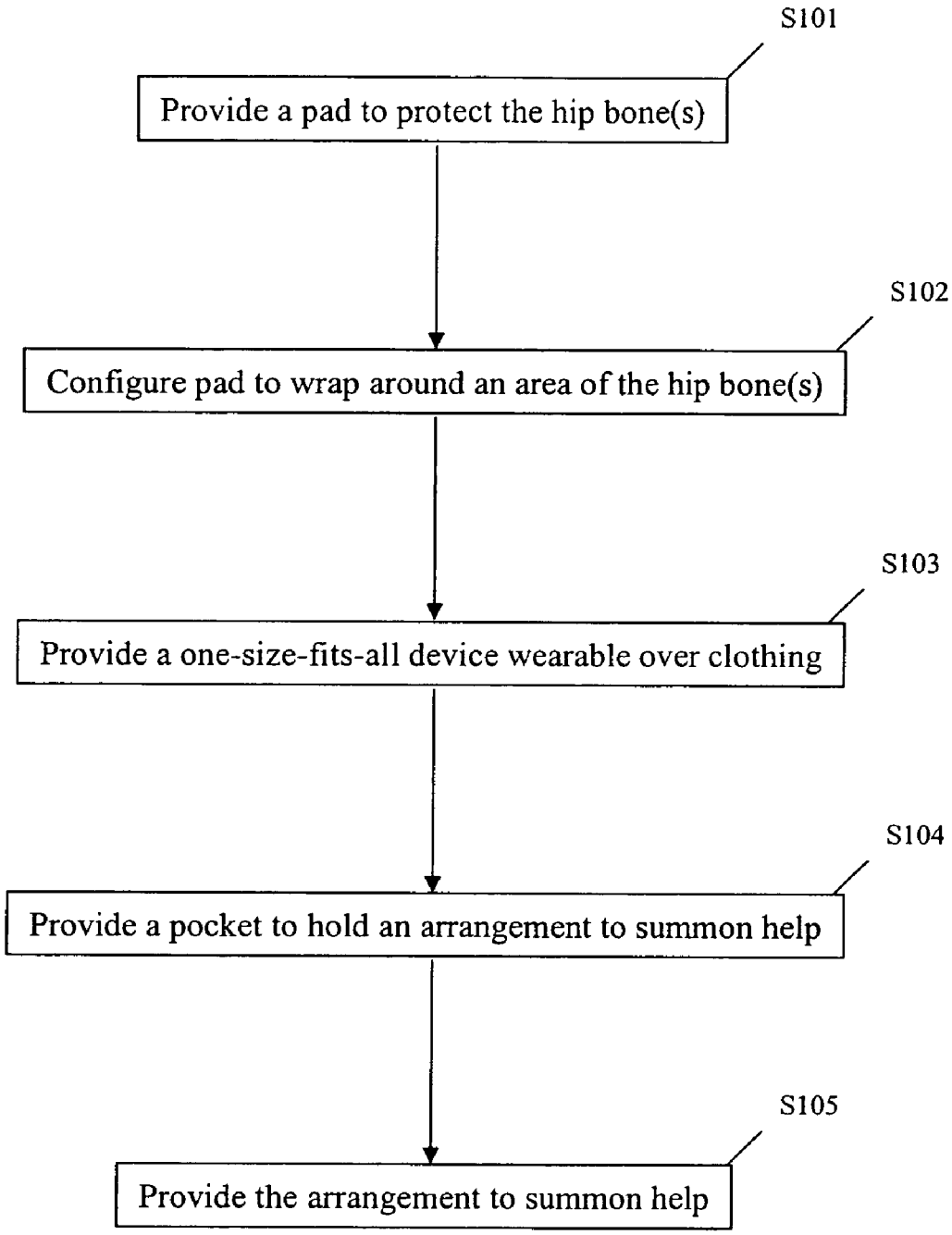
FIG. 1AA shows an exemplary method to protect a hip bone from fracture.
Figure 1A:
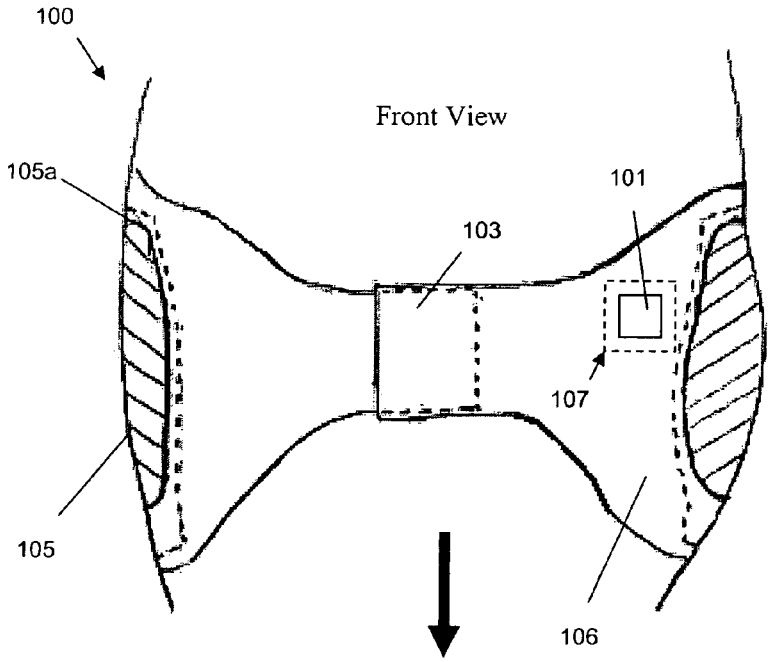
Figure 1B:
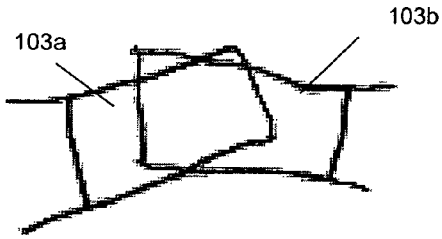
FIG. 1B shows an exemplary fastening device for securing the exemplary device of FIG. 1A to the hip area of the human.
Figure 1C:
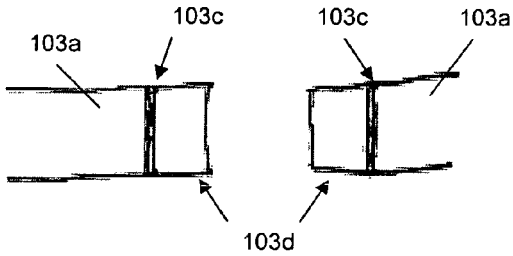
FIG. 1C shows exemplary double seams of the exemplary fastening device of FIG. 1B, at which a length of the fastening device may be removed using scissors to better accommodate a particular sized individual wearer.
Figure 1D:
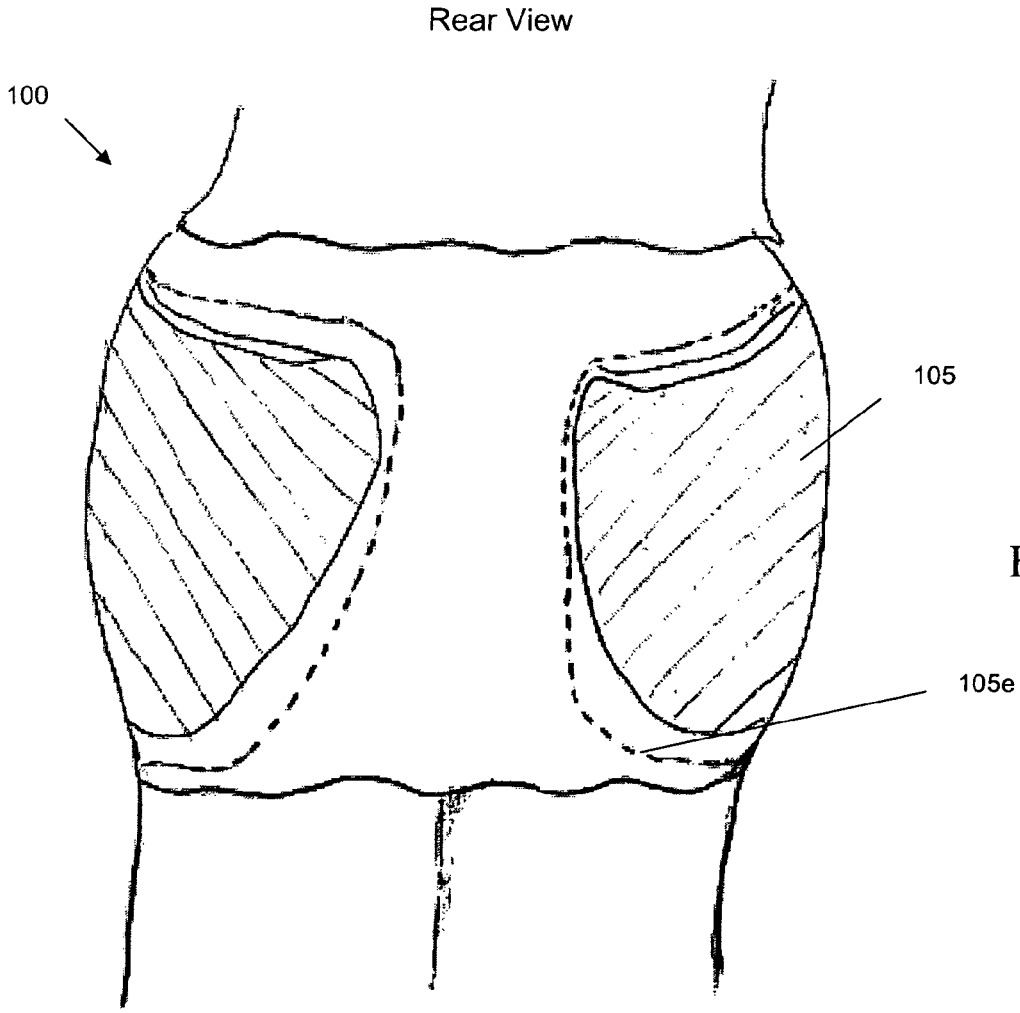
FIG. 1D shows a rear view of the exemplary device of FIG. 1A.
Figure 2:
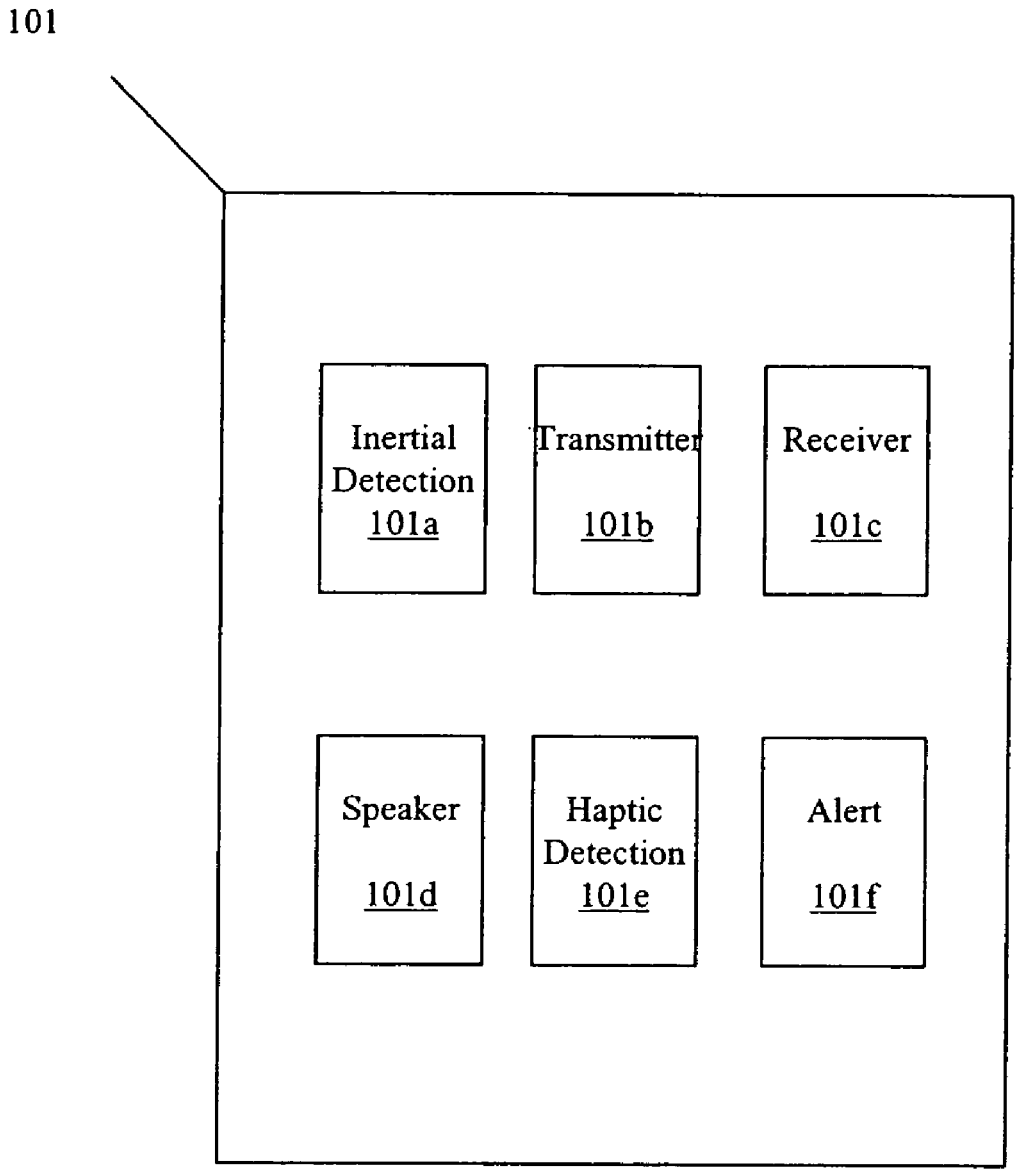
FIG. 2 shows an exemplary electronic device that may be provided with the exemplary device of FIG. 1A.

FIGS. 1A and 1D show a front and rear view of a human from slightly above the waistline to slightly below the buttocks, and a device 100 for protecting the hip area of a human. The protection may include, for example, protection against fracture, contusions, injuries to the skin and tissues lying below, which may occur, for example, from a fall. The device 100 includes a garment piece 106, an electronic device 101, a fastening device 103, at least one pad 105, and a slot/pocket 105*a* to hold the pad 105.

The garment 106 surrounds the human torso over the hip area to hold the device 100 in a suitable position. The garment 106 may be worn, for example, over clothing. In this regard, the garment 106 may be easily secured and/or removed. The garment 106 may be provided in a "one-size-fits-all" configuration, and may be made of an elastic spandex material, which may include a woven material from section to section as well, or any other suitably appropriate material.

The garment 106 may be provided in a color or pattern that is suitable for wearing over clothing. In particular, the garment 106 may be provided in a dark gray and/or brown color pattern. It is believed that the dark gray and/or brown color may be a desirable color since those who may wear the garment 106, including elderly persons, may tend to dress in darker shades and thus the dark gray and/or brown color may not contrast so greatly. Moreover, a dark gray and/or brown color may not show dirt or stains or other discolorations as noticeably. Moreover still, a dark gray and/or brown color may improve compliance—that is, the tendency of the wearer to accept the recommendation by a physician and a caregiver, to wear the device. Any color may, however, be used.

The device 100 includes a fastening device 103, which may be easily manipulated to adjust the device 100 to suit the particular needs of the wearer. In this regard, the device is configured for a wearer in a sitting position to be able to unfasten and refasten the device without rearrangement of the device with respect to the hips. Of course, the device may be unfastened and refastened in other positions as well, including the standing or lying down position.

The fastening device 103 may be provided in the form of two facing velcro panels 103*a* and 103*b*. In this regard, the overlap of the velcro panels 103*a*/103*b* is such that the garment 106 may be opened widely or less widely to accommodate wearers of multiple sizes. Instead of being fastened with both panels in an aligning axial position they may also be fastened in a manner where the longitudinal axis of one pad is at an angle to the longitudinal axis of the other panel, which may provide a more snug fit to accommodate the wearer's unique shape. In this regard, the width of the two panels may be configured to increase an overlapping area of the panels when the panels are fastened in a non-parallel manner.

In one exemplary embodiment, the velcro panels 103*a*/103*b* may be configured to accommodate nearly all potential wearers of the device. For example, certain potential wearers of the device may have a circumference at the hip area that is relatively large or, alternatively, relatively small as compared with the general population. Accordingly, providing a device that accommodates a wide variety of circumferences is believed to be desirable. In this regard, it is found that the potential wearers of the device include individuals whose circumference is as small as 32 inches or possibly even less, or as a large as 49 inches. Here, it is noted that the number of individuals whose circumference is less than 32 inches is expected to be quite small. It is also noted that most elderly people tend to lose weight as they age so that it is expected that most elderly wearers tend not to have a circumference that is nearly as large as 49 inches. Indeed, it is believed that most of the potential wearers who are elderly required a device that accommodates a much lesser circumference than 49 inches. Therefore, according to one exemplary embodiment, the velcro panels 103*a*/103*b* may be configured to include a section 103*d* that is easily removed or detached such that the potential wearer or caretaker may eliminate that portion of the panels that is not required to accommodate his circumference. For example, the velcro panels103*a*/103*b* may include a double seam 103*c* to subdivide the velcro panel in such a way that a section 103*d* of the velcro panels may be cut off using a pair of scissors, for example. (Note the double seam 103*c* allows the end the velcro panels that remains after cutting to have an appearance of being quite reasonably neatly finished). Hence, potential wearers of the device can more easily customize the fit. This is what enables the "one-size-fits-all" feature.

The "one-size-fits-all" configuration may also provide certain benefits with respect to cost, distribution and/or stocking of the device. For example, nursing homes or other similar care facilities may more easily maintain an adequate stock of the devices for expected and unexpected needs of the residents since a supply of only one type of device is needed to accommodate all or nearly all its residents.

The body of the device 100 includes materials that are expandable and non-expandable. The expanding materials in conjunction with the velcro closure serve to adjust the device 100 to the form of the body of the wearer, both for comfort and retension of the protective pads in their operative location. Expanding material is provided particularly between the pads 105 and around the front areas where the pads 105 are held fastened.

The device 100 includes at least one pad 105, which is constructed of a protective material within certain industry standards. In sports safety, automotive and other safety fields, a measure of protection that has become widely established is "G-max", which describes the maximum number of multiples of the force of gravity that result from a reversal of momentum caused by an object hitting the protective material. For protection against human bone fracture, a G-max value of 200 or less is believed to be desirable so as to prevent the most fractures and yet not be too thick. In this regard, a 7/16" thickness of, for example, the AMC material made by Armacell, is a closed cell polyvinyl chloride (PVC)-nitrile material that tests at this range.(Materials that absorb more force of impact are still being developed). In particular, the AMC material performs adequately when subjected to the ASTM F-355 prop Test, in which a steel cylinder is dropped on a sample of the material, which is situated on a steel surface connected to equipment which measures the impact over a period of time.

The at least one pad 105 may be constructed of a closed cell material that does not absorb body fluids such as urine and cleaning water when the pad is sponged or immersed in water.

Accordingly, the at least one pad 105 may provide certain benefits with respect to maintaining its cleanliness.

The at least one pad 105 may be shaped and/or adapted to the human torso in a wrap-around manner so as to protect certain bones of the human pelvis, including, for example, the greater trochanter or the two large hip-related bones, each consisting of three fused bones, the illium and ischium, which partially form a ring around a central cavity. The wrap-around construction additionally protects the fused terminal segments of the pelvis, known as the sacrum and coccyx. Accordingly, the at least one pad 105 may protect the wearer in the event of a backward or partially backward fall, which might otherwise cause injury or fracture of sacrum and coccyx, for example.

The at least one pad 105 may have an additional section that folds underneath the buttocks when the wearer assumes a sitting position. Accordingly, the at least one pad 105 is constructed to provide flexibility and protection at the same time.

The body device 100 includes an electronic device 101 to warn of risky movement and immediately alert the wearer, and also to detect a possible impending fall. In this regard, an alert may also be directed to a caregiver, such as, for example, a nurse at a nursing station, etc. If a person falls and fractures a hip, help cannot arrive too soon. Even if there is no hip fracture, help may nonetheless be needed and/or desired to provide prompt attention and aid to the patient, who may be distressed by the fall and/or may not be able to get up or even press a pendant button, such as has been provided in certain devices for various medial alerts, including those not connected with hip protecting features.

The electronic device 101 may include an inertial component 101*a* to detect a change in position. In this regard, the detected change in position may indicate, for example, that the wearer has experienced a fall. The electronic device 101 may also include a transmitter 101*b* to transmit a signal to a receiver (e.g., monitoring station, a nursing station, a home care giver, etc.), a receiver 101*c* to receive a signal from a transmitter (e.g., a broadcast station, etc.) and a speaker 101*d* to provide an audible alarm to the wearer of the device 100.

The electronic device 101 may also include a haptic component 101*e* to provide a vibration sensation to the wearer of the device 100 to indicate, for example, an impending fall or dangerous condition. In this regard, the haptic component 101*e* may provide a desired feature for those individuals whose hearing is impaired, or where an audible signal may be disturbing to the wearer or others in the vicinity of the wearer.

The electronic device 101 may be fixedly arranged in the device 100, or may be inserted or held in a pocket 107 of the garment 106. In this regard, the electronic device 101 may be easily removed when desired; for example, when the garment 106 is to be washed. The pocket 107 may be located, for example, where it is least exposed to outside impact. For example, the pocket 107 may be located above the hip and slightly anterior with respect to the torso.

The electronic device 101 may also be arranged in a slot 105*a* of the pad 105. In particular, the electronic device 101 may be arranged, for example, in an upper outermost corner of the pad 105. For this purpose, the garment need not require additional sewing operations. Moreover, the pad 105 may better protect the electronic device 101.

The electronic device 101 may also include a power source to provide power. Here, the power source may be, for example, a battery.

The electronic device 101 may also include a manual alert mechanism 101*f* so the wearer may manually activate an alarm condition to a nursing-station or a telephone line. In this regard, the telephone line may be, for example, a wireless connection, such as, for example, a cellular or mobile phone connection. The manual alert mechanism 101*f* may be, for example, in the form of a button, a dial, switch, microphone, or any other suitable form for enabling manual activation by the wearer or any other nearby person. In this regard, the microphone may be used, for example, to provide a voice-activated manual alert.

The manual alert mechanism 101*f* may be used to alert the nursing station to a fall, a fear of a fall, or any other condition that may require attention. In this regard, the wearer may alert, for example, that he or she may be experiencing a discomforting and/or life-threatening condition, such as, for example, a heat attack.

The manual alert mechanism 101*f* may include an element to deactivate it so that wearers or others may prevent unintended alerts and alerts from patients or wearers that occur with excessive frequency because the wearer is regarded to have not the capacity to properly judge when an activation is required and/or necessary.

What is claimed is:

1. A device for protecting a hip bone or limiting a severity of a hip bone injury, comprising:

at least one pad arranged to protect the hip bone; and a wearable garment to hold the at least one pad with respect to the hip bone, the garment configured to be worn over clothing and about the hips at all times without encircling the legs individually, the pad configured to wrap around an area of the hip bone in a circumferential manner, the garment including two fastening panels, each configured to face and overlap with the other fastening panel, and fastenable together in a rotatable manner around an axis perpendicular to a fastening plane;

wherein the garment includes at least one double seam so as to subdivide at least one of the two fastening panels, the at least one fastening panel thereby being configured for it's size to be reduced by cutting between the two seams of one of the at least one double seams in order to provide a one size fits essentially all wearers; and wherein when the size of one of the two fastening panels is reduced by cutting between the two seams of one of the at least one double seams, one of the seams of said double seam remains near an edge of said fastening panel, such that said edge of the fastening panel retains a finished look.

2. The device of claim 1, wherein the device is configured to accommodate a range of hip circumferences from about 32 to about 49 inches by reducing the size of the fastening panels.

3. The device of claim 1, wherein the device is configured for a wearer in a sitting position to be able to unfasten and refasten the device without rearranging the device with respect to the hip bone.

4. The device of claim 3, wherein the two panels are configured to have an overlapping area sufficient to keep the device fastened when the panels are fastened in a non-parallel manner of their longitudinal axes.

5. The device of claim 4, wherein the two panels fasten via at least one of force locking and frictional-based fastening.

6. The device of claim 1, wherein the device is configured to protect the greater trochanter and the illium.

7. The device of claim 6, wherein the device is configured to protect at least one of the sacrum and coccyx.

8. The device of claim 1, wherein the at least one pad has a fall protection that results in a G-max value of no greater than 200 during an impact.

9. The device of claim 1, wherein the wearable garment includes a pocket to hold at least one signaling device.

10. The device of claim 9, wherein the pocket is arranged forward of the at least one pad in a circumferential direction.

11. The device of claim 1, further comprising:

a notification arrangement to immediately notify a non-wearer of a fall occurrence.

12. The device of claim 11, wherein the notification arrangement includes a button accessible to the wearer.

13. The device of claim 11, wherein the notification arrangement is an audible alarm.

14. The device of claim 11, wherein the notification arrangement is a wireless communication device.

15. The device of claim 11, further comprising:

an impact detector to detect a fall, the impact detector including an accelerometer to detect a deceleration change, and a first processing arrangement to determine if the deceleration change is within a range in which a fracture may occur.

16. A device for protecting a hip bone from fracture, comprising:

at least one pad arranged to protect the hip bone; and a one size essentially fits all wearable garment worn about the hips at all times to hold the at least one pad with respect to the hip bone, the garment being configured to be worn over clothing and blending therewith and without encircling the legs individually, the pad configured to wrap around an area of the hip bone in a circumferential manner to protect the greater trochanter, the illium and at least one of the sacrum and coccyx, the garment including two fastening panels, each configured to face and overlap with the other fastening panel, and fastenable in a rotatable manner around an axis perpendicular to the fastening plane, the two fastening panels configured to have an overlapping area sufficient to keep the device fastened when the two fastening panels are fastened in a non-parallel manner of their longitudinal axes, the garment further including a pocket to hold at least one signaling device;

wherein the garment includes at least one double seam so as to subdivide at least one of the two fastening panels, the at least one fastening panel thereby being configured for it's size to be reduced by cutting between the two seams of one of the at least one double seams in order to provide a one size fits essentially all wearers; and wherein when the size of one of the two fastening panels is reduced by cutting between the two seams of one of the at least one double seams, one of the seams of said double seam remains near an edge of said fastening panels, such that said edge of the fastening panel retains a finished look.

17. A method to protect a hip bone from fracture or to limit a severity of a hip bone injury, comprising:

providing a "one-size-essentially-fits-all" hip protecting arrangement that includes at least one pad to protect the hip bone by wrapping around an area of the hip bone in a circumferential manner, the arrangement being configured to be worn over clothing and about the hips at all times without encircling the legs individually and including two fastening panels, each configured to face and overlap with the other fastening panel, and fastenable together in a rotatable manner around an axis perpendicular to a fastening plane;

providing a pocket on the arrangement to hold a device to provide notification of a fall occurrence to another person or informational system;

providing at least one double seam in the garment so as to subdivide at least one of the two fastening panels; and reducing the size of at least one of the two fastening panels by cutting between the two seams of one of the at least one double seams of the garment in order to provide a one size fits essentially all wearers;

wherein when the size of one of the two fastening panels is reduced by cutting between the two seams of one of the at least one double seams, one of the seams of said double seam remains near an edge of said fastening panel, such that said edge of the fastening panel retains a finished look.

18. The device of claim 15, wherein:

when the first processing arrangement determines that a deceleration change is within a range in which a fracture may occur the notification arrangement immediately notifies a non-wearer of a fall occurrence.

* * * * *